US006491591B1

(12) United States Patent
Schuster

(10) Patent No.: US 6,491,591 B1
(45) Date of Patent: Dec. 10, 2002

(54) PUTTER STABILIZING BRACE FOR PUTT TRAINING

(76) Inventor: Paul Scott Schuster, 5245 Oak Forest Dr., Racine, WI (US) 53406

( * ) Notice: Subject to any disclaimer, the term of this patent is extended or adjusted under 35 U.S.C. 154(b) by 0 days.

(21) Appl. No.: 09/301,816

(22) Filed: Apr. 29, 1999

Related U.S. Application Data

(60) Provisional application No. 60/083,998, filed on May 2, 1998.

(51) Int. Cl.[7] ..... A63B 57/00; A63B 69/36

(52) U.S. Cl. ..... 473/212; 473/276; 473/227; 473/206

(58) Field of Search ..... 473/212, 226, 473/227, 219, 223, 276, 206, 294, 328, 257, 340; 273/DIG. 30

(56) References Cited

U.S. PATENT DOCUMENTS

| | | | | | |
|---|---|---|---|---|---|
| 2,273,416 | A | * | 2/1942 | Norwood | 273/35 |
| 3,951,416 | A | * | 4/1976 | Koch et al. | 273/183 B |
| 4,023,812 | A | | 5/1977 | Lorang | |
| 4,210,334 | A | | 7/1980 | Lind | |
| 4,781,382 | A | * | 11/1988 | Hargraves | 273/183 B |
| 4,944,516 | A | * | 7/1990 | Bickler | 273/183 B |
| 5,127,650 | A | | 7/1992 | Schneller | |
| 5,145,179 | A | | 9/1992 | Breed | |
| 5,158,298 | A | | 10/1992 | Goins | |
| 5,174,575 | A | * | 12/1992 | Leith et al. | 273/187.2 |
| 5,248,146 | A | * | 9/1993 | Viets et al. | 273/189 R |
| 5,328,185 | A | | 7/1994 | Finnigan | |
| 5,342,055 | A | | 8/1994 | Diley | |
| 5,390,928 | A | | 2/1995 | Salini | |
| 5,465,971 | A | | 11/1995 | Tischler | |
| 5,470,073 | A | * | 11/1995 | Vasquez | 273/187.2 |
| 5,474,300 | A | | 12/1995 | Scalise | |
| 5,499,820 | A | | 3/1996 | Albertsson | |
| 5,501,464 | A | | 3/1996 | Dalbo | |
| 5,511,788 | A | | 4/1996 | Manley | |
| 5,520,392 | A | | 5/1996 | Foresi | |
| 5,527,090 | A | | 6/1996 | Stanley | |
| 5,595,544 | A | | 1/1997 | Roglke | |
| 5,904,624 | A | * | 5/1999 | Martinez | 473/212 |

* cited by examiner

*Primary Examiner*—Paul T. Sewell
*Assistant Examiner*—Sneh Varma

(57) ABSTRACT

The putt stabilizer improves a players putting stroke by providing a simple means to keep the wrist and forearm in position while making the stroke. The device braces the angle formed between the player's outside forearm and the putter shaft, allowing the player to keep this angle constant throughout the putt stroke. As the player learns to hold the proper position, they can gradually reduce their forearm pressure against the device until the preferred putting stroke can be made without aid from the invention.

15 Claims, 4 Drawing Sheets

PUTTER STABILIZING BRACE FOR PUTT TRAINING

This application claims the benefit of Provisional Application Ser. No. 60/083,998, filed May 2, 1998.

Background

1. Field of Invention

The present invention relates to the sport of golf, specifically to devices used to train the proper putting stroke.

2. Description of Prior Art

In golf, putting is an important part of the game that requires skill and proper technique in order to reduce the number of strokes needed to putt the players golf ball into the cup. In order to help players learn the proper putt stroke and in turn lower their scores, many training devices have been developed to aid the golfer in their wrist and arm positions.

The generally preferred method of putting is to keep a constant angle between the arms and the putter, providing a smooth, pendulum-like stroke deriving from the upper body. Although the rules of tournament play generally do not allow for such training devices, they can be used effectively when practicing the game, and can provide the player with the muscle development and wrist positions needed to learn the preferred method of putting a golf ball.

A device used to aid the golfer in the preferred putting method is disclosed in U.S. Pat. No. 4,944,516 (Bickler) 1990. The device attaches to the putter grip through a hole at the top of the grip found on some putters, and supports the golfers inside forearm to the longitudinal axis of the putter. Such a device, however, does not ensure a constant angle between the inner forearm and the putter shaft mainly because it must rely on the user to voluntarily press their forearm against the device during the putt stroke. This method in turn does not teach the correct muscle movements required during an unaided stroke because of this unnatural requirement to press inward on the trainer during use. Another related problem with supporting the inner forearm angle is the natural movement of the forearm to rotate outward, away from the device. When putting, the player's elbows are bent slightly, and the weight of the upper body (pivoting at the player's waist) tends to rotate the elbows outward, or in mechanical terms, buckle. This buckling of the player's arms is inevitable because the player's hands are fixed at a certain distance above the putting surface; determined by the length of the putter. This buckling effect will leave the inside forearm unsupported by the device. Also, on impact with the ball, the inside forearm tends to pivot away from the supported angle.

The most notable disadvantage of the Bickler device is its limitation to only one predetermined angle by design. The game of golf is an individual sport, and the players can range in size and shape. This vast field of different type players leads to infinite individual playing styles and abilities that makes the game so unique. An effective training device should teach the proper putting method without interfering with the player's own specific putting technique. In other words, the training device should train the user not to rotate their wrists rather than at what angle to hold the club.

Another disadvantage of the Bickler device is that in the patent claims it requires "the palm of the users hand (to) hold the (device mounting member) against the grip to stabilize the device during use." This requires the golfer to hold the device to the putter when using, which takes away the concentration needed to accurately putt the golf ball into the cup. Yet another disadvantage of the device is that it mounts to only standard type putters consisting of generally round grips with holes in the ends. The design also requires the player to grip over it to facilitate its use, resulting in a weaker grip on the putter handle, changing the unique shape of the handle, and covering a percentage of the handle material resulting in decreased grip. It would also not function well with the popular ergonomically shaped grips of today.

Another device to aid the player learn the preferred method of putting is disclosed in U.S. Pat. No. 4,781,382 to Hargraves (1988) This device consists of a generally linear arm secured to the putters grip's end above the player's hands that can be rotated outward at a right angle to the club shaft. The device is intended to prevent the golfer's wrist from twisting when putting the ball. Such a device; however, does not rigidly hold the proper angle between the forearm and wrist required for the preferred putting method because the supported arm merely rests against the device and can easily slip by if desired by the user. In other words, the angle is held only by a frictional force between the forearm and the device, and can easily be overcome. In order to hold this preferred angle, the user must exert a compression force against the device to increase the static frictional force to prevent slippage. This requirement again takes away from the concentration needed to accurately putt the golf ball.

Another device to aid the golfer in learning the preferred method of putting is disclosed in U.S. Pat. No. 5,465,971 to Tischler (1995). This device consists of a device affixed to the handle of the putter extending upwardly at an obtuse angle to engage with the golfer's armpit. This device may hold the preferred wrist to forearm angle indirectly; however it seems awkward to use, and must be stored separated from the putter. Providing a pivot point in the armpit of the user does not reinforce the muscle and arm positions needed when the device is not used. In other words, the user merely pivots the putter at the pivot point located in the user's armpit, not developing any special skills or muscle positions. Similar devices are found in U.S. Pat. Nos. 5,342,055 (Diley) and 5,520,392 (Foresi).

Other devices to aid the golfer learn the preferred method of putting by holding the wrist to forearm angle are disclosed in U.S. Pat. Nos. 5,158,298 (Goins), 5,499,820 (Albertsson), 5,511,788 (Manley), and 5,527,040 (Stanley). These devices are worn by players around their wrist and lower forearms to keep the proper angle. These devices, while maintaining the proper angle, require the player to wear the device when aid is needed. They also provide some degree of difficulty to attach and remove from the player's arm, and do not give the player the quick option to putt without the aid of the device during practice.

Objects and Advantages

Accordingly, several objects and advantages of my invention are:

a) To properly locate and position the off target wrist and forearm required for the preferred putting stroke.

b) To provide alignment of the putter head perpendicular with the intended path of the golf ball by keeping the putter head from twisting during the stroke.

c) To provide a training device that attaches quickly and easily to the golf club.

d) To provide a training device that can be retracted such that the club it is attached to can be easily placed back into the golf bag or carrier.

e) To teach the user to putt with shoulders and upper body, and not the wrists to provide the preferred putting stroke.

f) To hold the angle formed between the shaft of the putter and the outer forearm during the entire putt stroke.

g) To provide a training device that can be quickly placed in the stowed position when the user wants to use the putter in traditional fashion.

h) To provide a training device that can be easily adjusted to brace any wrist to forearm angle, independent of the player's size or putting style.

I) To provide a training device made of extremely light weight materials that can withstand the elements and putting forces, and provide the user with a comfortable fit.

j) To provide a firm impact against the ball by directing the force used to strike the golf ball to the upper arms and body.

k)To improve the follow through after the putting stoke by providing momentum to drive the golf ball with the upper body.

l) To provide a training device that feels natural, not requiring the use of muscles or arm positions not associated with the preferred putting stroke, and accomplishing this goal with only one point of contact with the user.

m) To provide training for both regular and reverse hand grip styles.

n) To provide the user with instant detection of wrist rotation during the stroke.

o) To provide a single training device that allows the user to actually learn the preferred method of putting through a series of specific training positions and varying pressures, with the final goal being to eventually wean the user from the training device p) To provide a training device that can be used with right or left handed players.

List of Reference Numerals

2 Putt Stabilizer 24 Putter Shaft

4 Stabilizer Bar 26 Putter Grip

Figure 1:
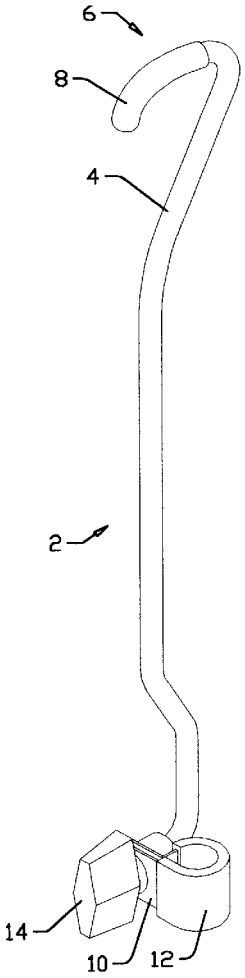
FIG. 1 shows an embodiment of the putt stabilizer in a front isometric view.

6 Forearm Cradle Assembly 28 Putter Head

8 Forearm Pad 30 Off-Target Forearm

10 Shaft Clamp 32 Off-Target Wrist

12 Clamp Pad 34 Target Forearm

14 Internal Threaded Knob 36 Target Wrist

16 Spacer 38 Upper Body

18 Golf Player 40 Off-Target Foreann to Putter Shaft Angle

20 Putter 42 Off-Target Forearm to Putt Stabilizer Angle

22 Putter Face 44 Brace Angle

SUMMARY

The principle object of the putt stabilizer is to improve a players putting stroke by providing a simple means to keep the hands, wrists, and forearms in position when making a golf stroke. The putt stabilizer by design braces the angle formed between the player's off-target outside forearm and the putter shaft. It is intended to train the player in the preferred golf stroke position by providing a gentle force on the players off-target outside forearm to counter-act the natural outward movement of the players elbows. This force and angle is held constant by the user throughout the entire putting stroke.

As the player learns to hold the proper position by locking the rotation of the wrist and elbow joints, they can gradually reduce their forearm pressure against the putt stabilizer until the preferred putting stroke can be made without aid from the invention. It is designed to be a tool to teach the proper putting stroke without interfering with the player's own specific technique of putting a golf ball.

DESCRIPTION OF INVENTION

A typical embodiment of the putt stabilizer 2 is shown in FIGS. 1, 2, 3, and 4. It consists of a flat, c-shaped shaft clamp 10 at its base used to attach stabilizer 2 to a putter 20 (FIG. 5). Most putter shafts 24 have a diameter of about a half an inch (½) near the grip; therefore, clamp 10 is sized accordingly. A protective rubber clamp pad 12 insulates clamp 10 from marring shaft 24. Clamp 10 has a clearance hole at the end of each leg, providing a means for a threaded fastener to pass through.

Figure 4:
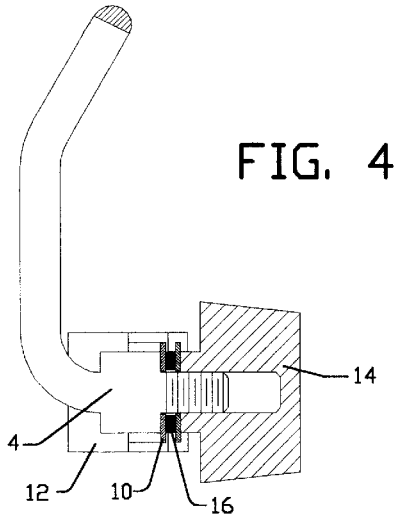
FIG. 4 shows a section view of the putt stabilizer, showing the internal construction.
Figure 3:
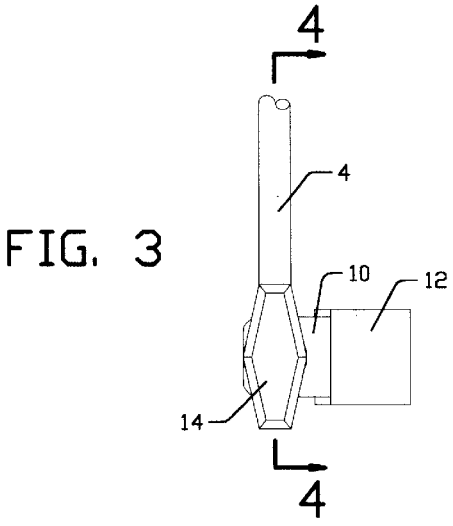
FIG. 3 shows an embodiment of the putt stabilizer in a front view.
Figure 5:
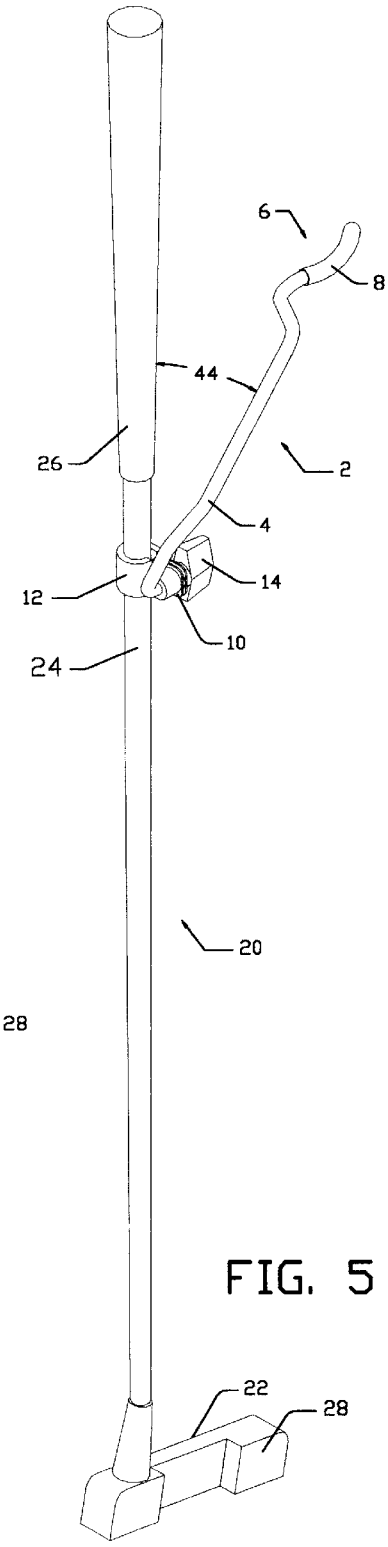
FIG. 5 Shows an embodiment of the putt stabilizer attached to a putter rotated into the working position, viewed from the back.

A round stabilizer bar 4 having an external threaded end and shoulder, extends through the clearance holes in clamp 10 until stopped by the shoulder located just above its threaded end (FIG. 4). A ¼" diameter aluminum rod has been found to be an adequate material for the construction of bar 4. An internal threaded knob 14 is threaded onto the portion of bar 4 extending through clamp 10. As the knob is threaded onto bar 4, the legs of clamp 10 are drawn together, decreasing its internal diameter. A spacer 16 of predetermined thickness, is positioned between the two legs of clamp 10 to limit the internal clamping diameter. The thickness of spacer 16 can be changed to accommodate different diameters of shaft 24. Knob 14 is tightened to a torque that prevents bar 4 from rotating within the clearance holes of clamp 10. It also prevents the internal diameter of clamp 10 to decrease further and place undue stress on shaft 24 when mounted on putter 20.

Figure 2:
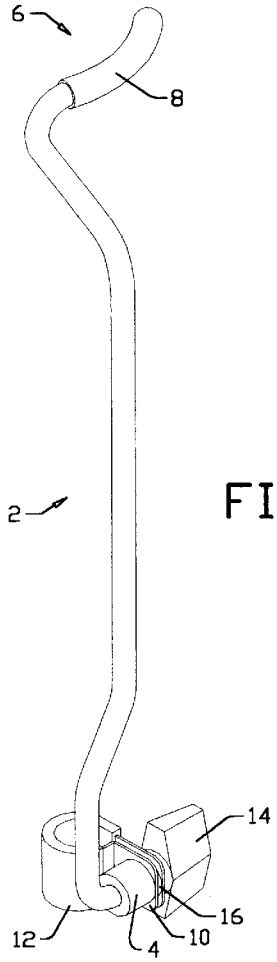
FIG. 2 shows an embodiment of the putt stabilizer in a back isometric view.
Figure 6:
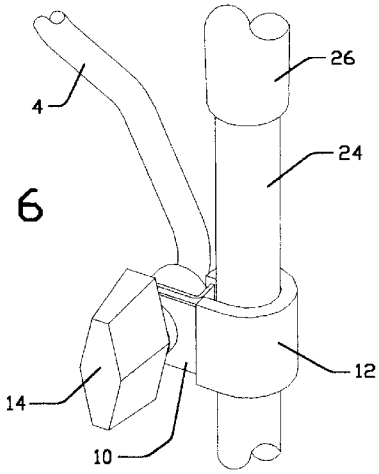
FIG. 6 Shows a close-up isometric front view of the putt stabilizer attached to the putter, rotated into the working position.
Figure 7:
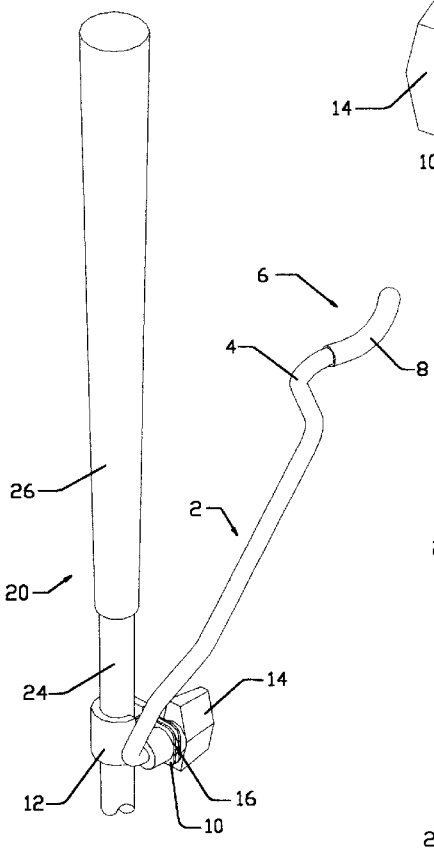
FIG. 7 Shows a close-up isometric back view of the putt stabilizer attached to the putter, rotated into the working position.
Figure 8:
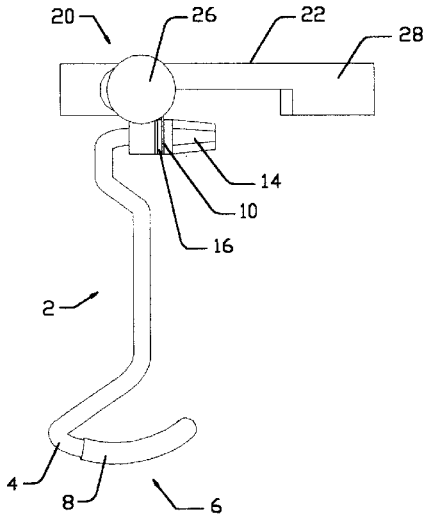
FIG. 8 Shows a top view of the putt stabilizer rotated into the working position.
Figure 9:
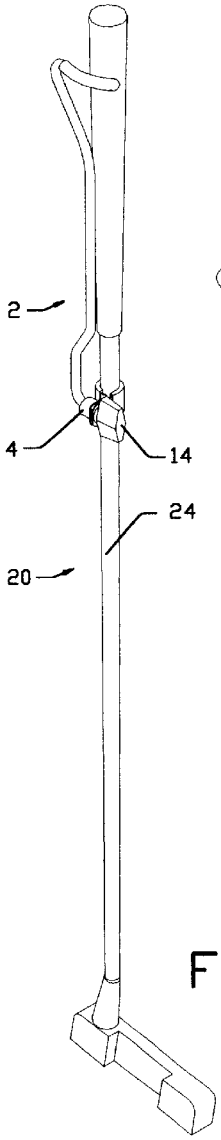
FIG. 9 Shows the putt stabilizer attached to a putter, rotated to a stored position.
Figure 12:
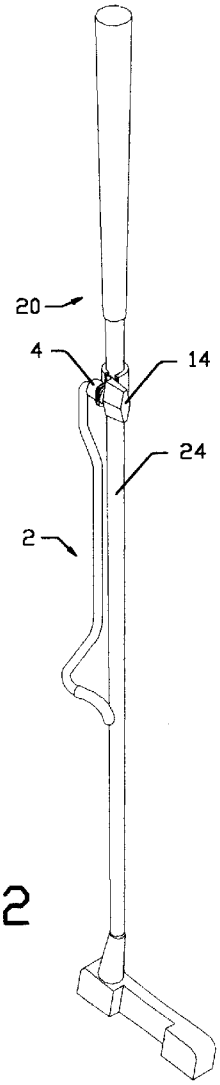
FIG. 12 Shows the putt stabilizer in a stored position attached to a golf putter, which allows the putter to be used in traditional fashion.

Bar 4 is bent perpendicular to its threaded end as it extends away from the base to its distal end (FIG. 2). At its distal end, bar 4 is bent parallel with its threaded end. The parallel portion is curved shaped to cradle a users forearm (FIGS. 8 & 13B). A forearm cradle pad 8 is mounted coaxial at the bar's curved end, creating a forearm cradle assembly 6. Additional bends are made to the middle section of bar 4 to provide a close fit with putter 20 when located in the two stored positions (FIGS. 9 & 12).

Operation of Invention

Figure 10:
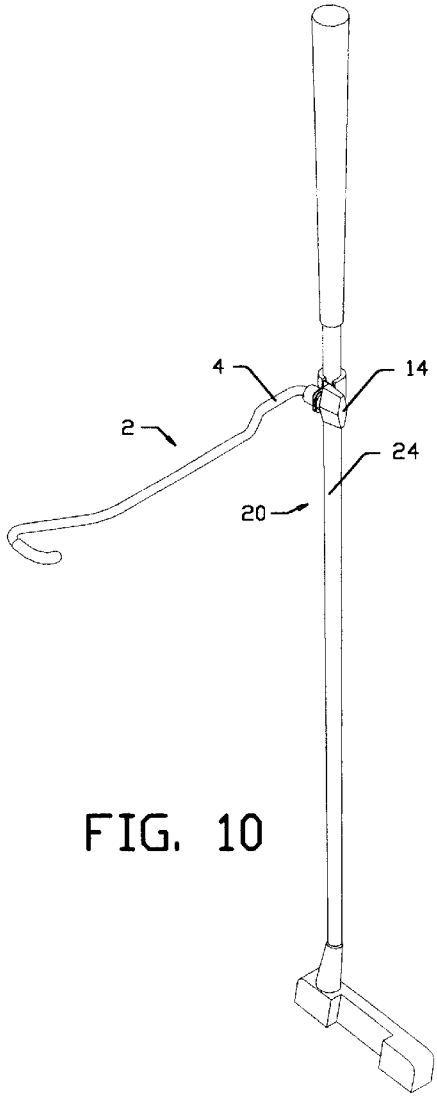
FIG. 10 Shows the putt stabilizer attached to a putter, rotated to an extended position perpendicular with the putter shaft.

The putt stabilizer 2 is mounted on the putter shaft 24 just below the putter grip 26 (FIG. 5). It can be adjusted to fit many different size players. When knob 14 is loosened, stabilizer 2 can be slid along the longitudinal axis of putter 20, and be rotated 360 degrees to any position around shaft 24. Also with knob 14 loose, bar 4 can also be rotated 180 degrees as seen in FIGS. 9, 10 & 12. The tightening of knob 14 secures both clamp 10 onto shaft 24, and the position of bar 4 within clamp 10.

To start training with stabilizer 2, brace angle 44 is adjusted to allow the forearm cradle assembly 6 to contact forearm 30 anywhere between the wrist and elbow when player 18 is in the preferred putting position (FIGS. 5 & 13B). Player 18 then applies a gentle force against cradle 6 with forearm 30 by lightly rotating the elbow outward from wrist 32. Note that this force is not exerted by the arm muscles, but is produced by allowing the weight of the upper body 38 to naturally rotate the elbows outwards, bringing forearm 30 to rest against cradle 6. At this point angle 40 is braced from further rotation, and player 18 can not bend back wrist 32 (FIG. 13B). Player 18 is now in proper position to stroke putter 20 from the upper body 38.

Figure 13A:
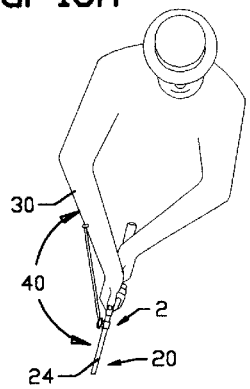
FIGS. 13A–C Shows a player using the putt stabilizer to keep the angle between the off target wrist and outside forearm constant throughout the putt stroke (striking ball to player's left).
Figure 13B:
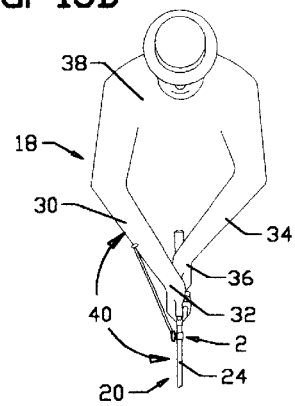
Figure 13C:
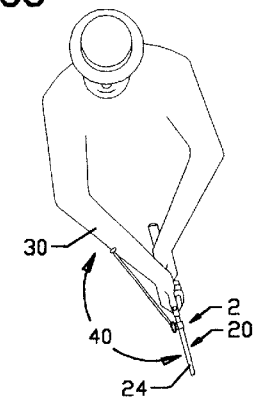

As player 18 draws putter 20 back, forearm 30 maintains the gentle resting force against cradle 6 (FIG. 13A). This force holds angle 40 constant throughout the backstroke and into the follow through stroke (FIG. 13C). Holding the force constant against cradle 6 is the key to the putting stroke training because it teaches the user which muscle groups they need to hold into position to ensure a proper stroke. It also reinforces the technique of stroking putter 20 with upper body 38. Over time the player learns to use the upper body to putt the ball. Without holding angle 40, wrist 32 tends to flex back, taking away energy from the impact with the ball, typically resulting in a short putt. This can also lead to the putter head 28 twisting (which also takes energy from the impact) and most likely deflects the golf ball into an undesired direction.

The curved surface of cradle 6 (FIG. 8), which is in contact with forearm 30 of player 18, inhibits wrist 32 from twisting putter 20 along its horizontal axis. This insures a square impact against the golf ball.

Figure 11:
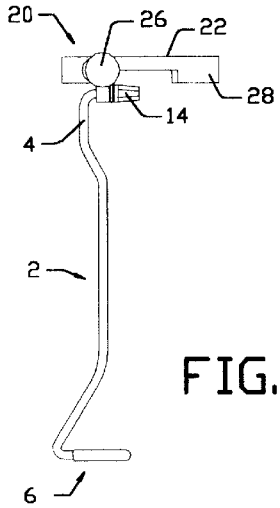
FIG. 11 Shows a top view of the putt stabilizer positioned perpendicular to the putter shaft and parallel with path of golf ball.
Figure 14A:
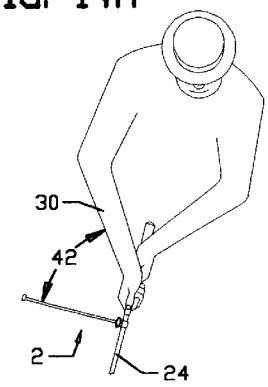
FIGS. 14A–C Shows a player using the putt stabilizer to keep the angle between the off target wrist and outside forearm constant visually, with no physical contact with it (striking ball to player's left).
Figure 14B:
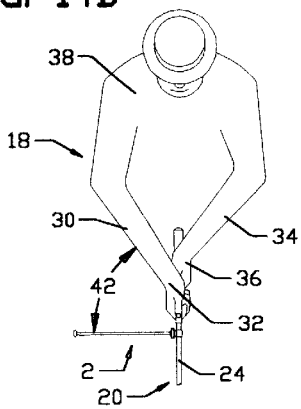
Figure 14C:
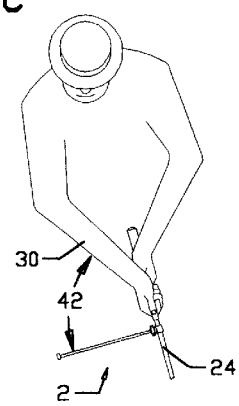

As a player begins to learn the proper putting stroke, the forearm contact on cradle 6 of stabilizer 2 should decrease until no contact is needed during the stroke. At this point stabilizer 2 can be rotated into a position where bar 4 is perpendicular to shaft 24, and parallel with the intended trajectory of the ball (FIGS. 10 & 14B). In this position, player 18 can visualize holding angle 42 constant without any physical contact with it. During the stroke (FIGS. 14A–14C) with upper body 38, player 18 maintains angle 42 by holding the learned muscle positions described above. This position also allows the user to easily detect unwanted rotations of the club face 22 about the horizontal axis of putter 20 by watching the sweeping angle of bar 4 at its cradle 6 end (FIG. 11). In other words, the extended bar 4 should always be in line with the intended trajectory of the ball during the stroke. With bar 4 extended, it is easy to detect small rotations of putter 20 at a point radial outward from the center of rotation. This detection method can ensure face 22 to be perpendicular with the intended path of the ball.

Figure 15A:
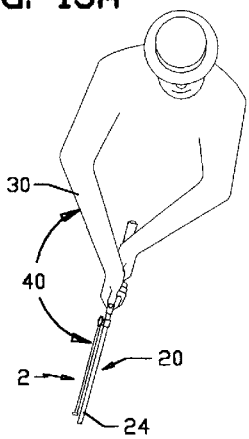
FIGS. 15A–C Shows a player confident in their putt training by having the putt stabilizer rotated and secured into the stored position during the stroke, which allows an unaided putt stroke (striking ball to player's left).
Figure 15B:
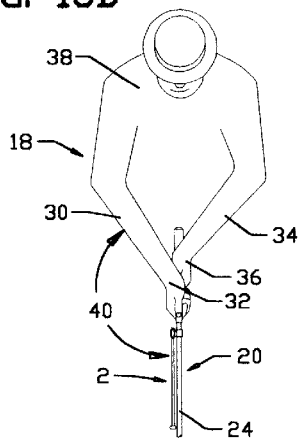
Figure 15C:
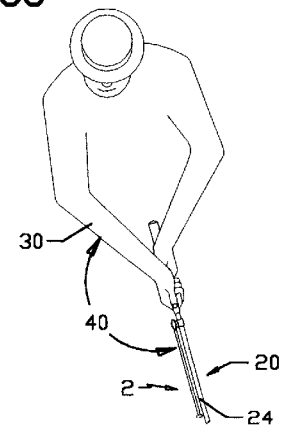

When a user is confident in their putt stroke, stabilizer 2 can be rotated into a stored position (FIG. 12) that will not interfere with the users trained ability to putt a golf ball without aid. In FIGS. 15A–15C, player 18 maintains angle 40 throughout the stroke by applying the training methods and muscle positions described above.

In some cases, players use what is known as a 'reversed grip'. In this grip, the hand on the arm towards the hole is placed lowest on grip 26. The stabilizer 2 can be easily adjusted to brace the leading target forearm 34 by rotating it around shaft 24. This position can also be a useful for players using a regular grip that have a tendency to bend their wrists towards the hole during the stroke.

When training is complete, stabilizer 2 can be stored in a position where bar 4 is parallel with shaft 24 (FIGS. 9 & 12). In tournament play, the putt stabilizer 2 can be easily be removed from putter 20 by removing clamp 10 from shaft 24.

Ramifications

A possible embodiment of the invention could be a one piece molded plastic stabilizer bar that snaps onto the putter shaft with a predetermined brace angle. Although this embodiment would not be as versatile as the preferred embodiment, it would still brace the player's forearm by the preferred method. Another possible embodiment might have a straight stabilizer bar that provides a single point contact with the forearm (no bends or cradle assembly). In this case, the putt stabilizer would provide a much smaller profile when placed in the stored position.

The stabilizer bar itself can be made of many different sizes, shapes, materials, cross sections, and mounting techniques. The manner in which the putt stabilizer is attached to the club can also be accomplished by numerous methods by those skilled in the art.

Another natural evolution of the invention would be to incorporate it directly into the putter shaft or equivalent. The stabilizer bar could be welded, bolted, pinned, threaded, etc. to the shaft. This would be useful when developing new putter designs, practice only putters, and stroke development aids (weighted clubs to train and loosen muscles).

Although the current favored design of the putt stabilizer can be adjusted to fit the many different sizes and putting styles of golf players, it still provides the preferred method of bracing the outside forearm throughout the stroke. It is clear to the applicant that there are many different ways the putt stabilizer can be designed to provide the same results. The preferred embodiment described within should not limit the invention in any way.

I claim:

1. A putt training device to improve a players putting stroke by keeping the hands, wrists, and forearms in position when making the stroke by employing a single brace means, said device comprising a stabilizer bar pivotably attached to a clamp, said bar having a single point contact end and a fastener end, said bar secured to said clamp at said fastener end by a threaded fastener, said fastener securing said clamp to the putter shaft just below the hands, said bar having adequate length to contact the backside of the player's off-target forearm at a point between the wrist and elbow while in a preferred putting position, allowing the player to apply force against said brace with said forearm by controlling rotation of the elbow outward from the wrist with muscle control, bringing the forearm to rest against said contact end in an un-restrained manner; effectively bracing the off target forearm to putter shaft angle from further rotation, concurrently preventing the player's wrist from bending backwards; whereby the player can stroke the putter from the upper body, maintaining said position by holding said force constant throughout the entire putting stroke, effectively training the player in the preferred golf stroke.

2. The putt training device in claim 1, wherein said player learns to hold the proper position by locking the rotation of the wrist and elbow joints with said control, said player can gradually reduce said force against said device during training, until the preferred putting stroke can be made without aid from the invention, whereby the device can teach the proper putting stroke without any physical interference with the player's own specific technique of putting a golf ball.

3. The putt training device in claim 1, wherein any variation of said force instantly signals detection of wrist rotation to the player, reinforcing said unrestrained muscle control.

4. The putt training device in claim 1, wherein said device comprises a flat, c-shaped shaft clamp at its base used to mount the device to a putter shaft below the grip, having a inside diameter sized accordingly to said shaft, the clamp further having clearance hole at the end of each leg, providing a means for a threaded fastener to pass through; a stabilizer bar having an external threaded end and shoulder, extending through said clearance holes until stopped by said shoulder located just above said threaded end, a internal threaded knob threaded onto the portion of said bar extending through the clamp, said knob employed to draw together the legs of the clamp, decreasing its internal diameter, tightened to a torque that prevents the bar from rotating within the said clearance holes of the clamp; the bar formed about perpendicular to the threaded end, extending away from the clamp to a distal end, formed to contact a users said forearm, whereby said device can physically achieve the mechanical requirements of said training.

5. The putt training device in claim 4, wherein said clamp has a protective rubber pad insulating said clamp from marring the shaft.

6. The putt training device in claim 4, wherein said bar is an aluminum rod.

7. The putt training device in claim 4, wherein said bar is a rod having about ¼" diameter.

8. The putt training device in claim 4, wherein said clamp includes a spacer of predetermined thickness positioned between the two legs of the clamp to limit the internal clamping diameter, wherein the thickness of said spacer can be changed to accommodate different diameters of said shaft, additionally preventing undue stress on the shaft.

9. The putt training device in claim 4, wherein said bar is formed to cradle a player's said forearm.

10. The putt training device in claim 9, wherein said bar contains a pad at its distal end to comfort the player.

11. The putt training device in claim 4, wherein said bar is formed to provide a close fit with a putter when located in the stored position(s).

12. The putt training device in claim 4, wherein design of said training device is easily adjusted to fit many different size players by loosening said knob, the device can be slid along the longitudinal axis of the putter, be rotated 360 degrees to any position around the shaft, said bar mounting having rotation within said clamp of about 180 degrees, whereby the tightening of the knob secures both the clamp onto the shaft, and the position of the bar within the clamp; providing infinite adjustment by a single means.

13. The putt training device in claim 12, wherein said bar can be rotated and tightened into a position about perpendicular to the shaft, and about parallel with the intended trajectory of the ball, whereby said player can visualize holding the off-target forearm to putt stabilizer angle constant, without any physical contact with it, by muscle control during the stroke.

14. The putt training device in claim 12, wherein said bar can be rotated and fastened into a stored position that will not physically interfere with the users trained ability to putt a golf ball without aid, whereby a player can confidently apply muscle control to maintain the off-target forearm to putter shaft angle throughout the stroke.

15. The putt training device in claim 4, wherein said bar can be rotated and fastened to brace the leading target side forearm by adjusting the stabilizer bar to contact the backside of said forearm anywhere between the wrist and elbow while the player is in the preferred putting position; the player applies said force against the device with said forearm by controlling rotation of the elbow outward from the wrist, allowing the weight of the player's upper body to naturally rotate the elbows outwards, bringing the forearm to rest against the cradle; effectively bracing the forearm to the putter shaft angle from further rotation, additionally preventing the player's wrist from bending backwards towards the target, whereby the device positions the player to stroke the putter from the upper body, maintaining said hands, wrists, and forearms in position when performing the stroke.

* * * * *